United States Patent [19]

Cummins

[11] 3,995,863

[45] Dec. 7, 1976

[54] FOOTBALL BOARD GAME AND TEACHING AID

[76] Inventor: Robert E. Cummins, 734 E. Wabash, Carthage, Ill. 62321

[22] Filed: Aug. 25, 1975

[21] Appl. No.: 607,102

[52] U.S. Cl. ..... 273/134 CF; 273/94 R

[51] Int. Cl.[2] ..... A63F 3/00

[58] Field of Search ..... 273/94, 131, 134

[56] References Cited

UNITED STATES PATENTS

| | | | |
|---|---|---|---|
| 1,633,040 | 6/1927 | Schurch | 273/94 |
| 1,675,619 | 7/1928 | Sorlien | 273/94 |
| 2,180,478 | 11/1939 | Pekalski et al. | 273/94 |
| 2,458,388 | 1/1949 | Kobs | 273/94 |
| 2,784,970 | 3/1957 | Heiner | 273/94 |
| 3,352,558 | 11/1967 | Lucas | 273/134 GM |

*Primary Examiner*—Delbert B. Lowe

*Attorney, Agent, or Firm*—Thomas M. Scofield

[57] ABSTRACT

An improved board game based upon American football; an improved board display and elements therefor including a scaled football field representation, score markers, down and quarter markers, ball position markers, and, as well, a reversible, invertible, largely transparent slide indicator actively cooperating with the field representation, which represents, successively, play moving from each end of the field and additionally serves as a strategy selector for both defense and offense; an array of probability (chance) dial selectors so presented and structured as to permit in depth representation and operation of all the features and facets of play of football on both defense and offense; a teaching device employing the subject board game and its apparatus elements.

7 Claims, 8 Drawing Figures

DOWN
HOME

FOOTBALL BOARD GAME AND TEACHING AID

THE PRIOR ART

I am aware of the following prior art references relating to board games:

Schurch U.S. Pat. No. 1,633,040 issued June 21, 1927 for "Football Game Apparatus";

Scott U.S. Pat. No. 1,969,429 issued Aug. 7, 1934 for "Game of Skill"; and

Lucas U.S. Pat. No. 3,352,558 issued Nov. 14, 1967 for ". . . Golf Game Board . . . ".

OBJECTS OF THE INVENTION

A first object of the invention is to provide an improved board game which is based upon football.

Another object of the invention is to provide very much improved apparatus to be employed in a board game based upon football, which apparatus involves not only relatively conventional game board elements such as a scaled football field representation, score markers, down and quarter markers and ball position markers, but, additionally, a very greatly improved slide indicator having a particular structure and indicator pattern thereon, which is invertible and reversible to be used, as a single entity, to successively represent plays moving from either end of the field.

Another object of the invention is to provide such a previously described football board game and apparatus associated therewith, which additionally provides greatly improved chance devices defining fully the wide variety of conditions and situations which may occur during a football game, such chance indicators yet conveniently presentable in parallel arrays associated with the scaled football field representation, whereby to be adapted to large scale representation (such as in a classroom) or smaller, foldable board representation equally well.

Another object of the invention is to provide a remarkable new teaching device comprising the described football board game and associated apparatus, which apparatus may particularly be used in grade school, Bible school classes, high school, etc., to aid in the teaching of substantially any subject, in that the students in the particular class may be grouped into terms and the successful or unsuccessful answering of questions related to the subject couples with the mechanics of play and operation of the game.

Another object of the instant invention is to provide an improved football board game and apparatus elements thereof which are very effective and adaptable in and to, respectively, the teaching of the game of football itself, the mechanics of the game being adaptable to either the "pro" football rules, college football rules, high school rules, or the like.

Other and further objects of the invention will appear in the course of the following description thereof.

In the drawings, which form a part of the instant specification and are to be read in conjunction therewith, an embodiment of the instant invention is shown and, in the varied views, like numerals are employed to indicate like parts.

FIG. 1*a* is a plan view of one part of the board of the subject football board game, including the scaled fields representation, the score marking zones, down and quarter marking zones and the ball and yards-to-go position indicators.

FIG. 1*b* is a plan view of the remaining part of the board of the improved football board game comprising the probability dial or chance device arrays which, as illustrated, are arranged in two rows parallel to the longitudinal axis of the football field representation on the board.

DESCRIPTION OF THE GAME BOARD

Figure 1A:
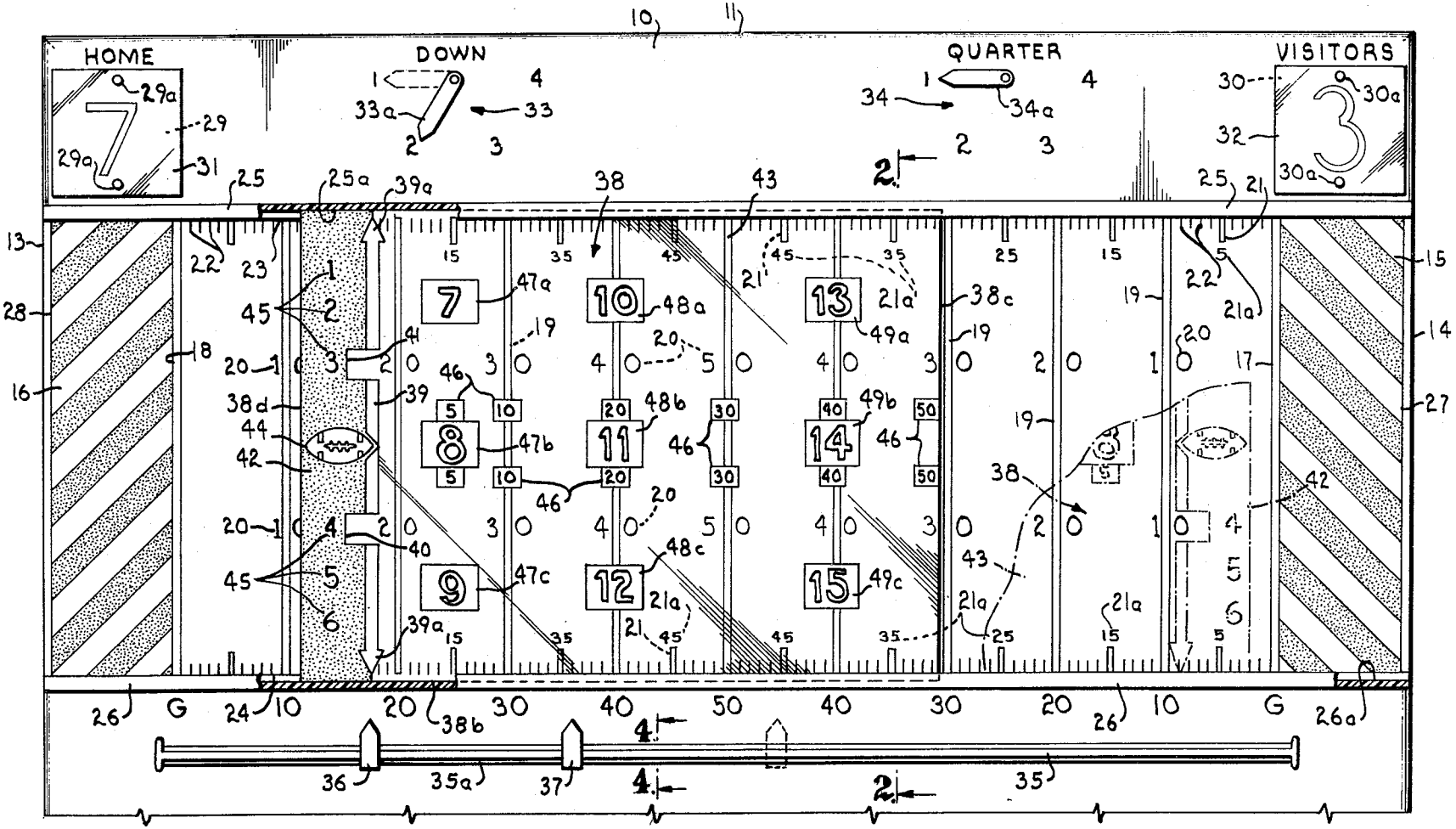
Figure 1B:
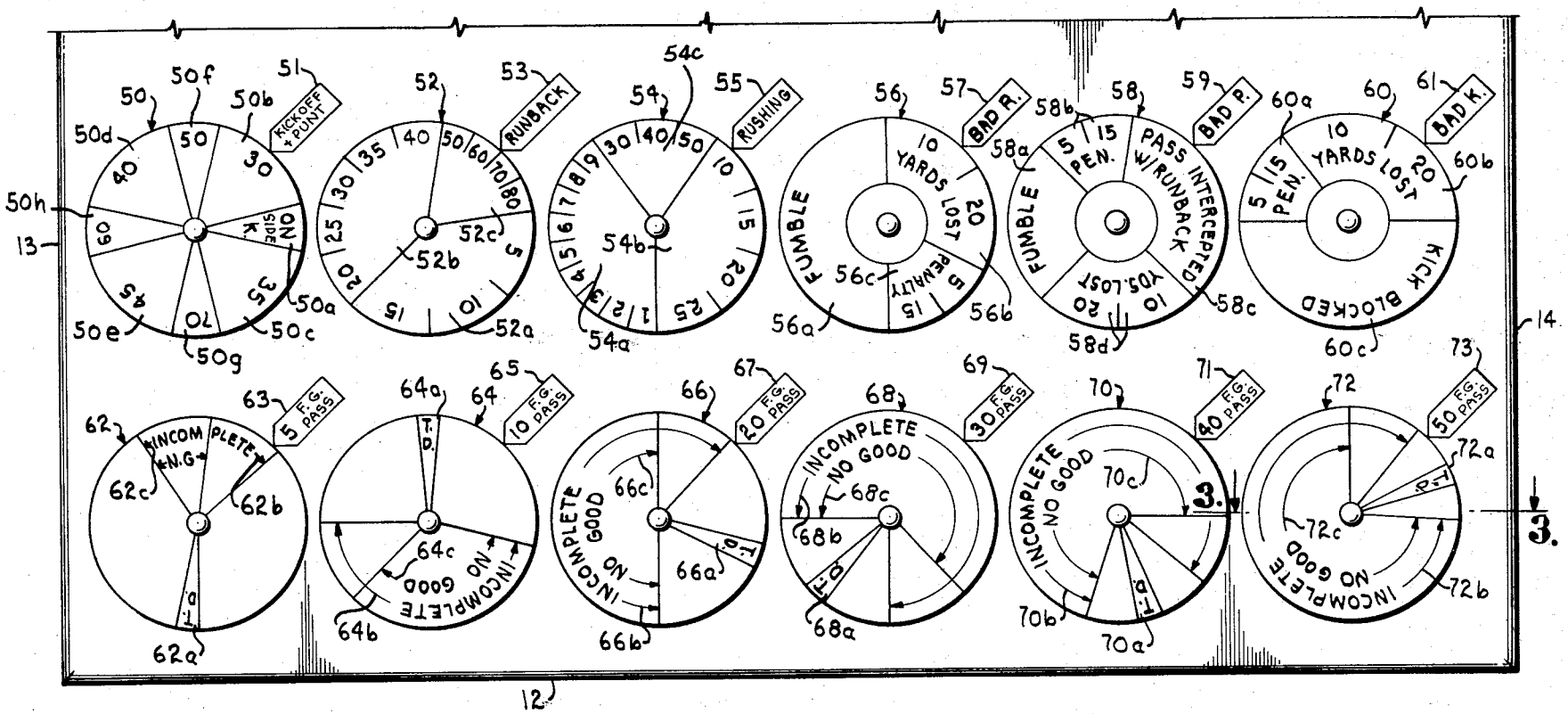

FIGS. 1*a* and 1*b* show two sections of an integral, foldable game board which contains thereon all of the basic operating elements of the board for use in the game. FIG. 1*a* is a plan view of that part of the board which includes the scaled field representation and, associated therewith, score marking zones, down-quarter marking zones and the ball and yards-to-go position indicators. FIG. 1*b* is a plan view of that part of the board which comprises or includes the probability dials or chance devices which, as illustrated, are arranged in two rows parallel to the longitudinal axis of the football field representation on the board. In the event that a portable, foldable board use is not employed, the elements shown in these figures, considerably up-scaled in size, can be used in perpendicular, blackboard or wall mounted form. The parts are movable and functional as will be herebelow described in either small or large from representations of the game.

A written book or brochure of rules for the game is also supplied, but this is separate from the game board and operating elements thereof.

Referring, then, to FIG. 1*a*, the game board itself is generally designated 10 with end edge 11 running parallel to opposite end edge 12 (FIG. 1*b*) with parallel side edges 13 and 14. A suitable fold line or zone (not shown) is typically positioned between the portion of the board seen in FIG. 1*a* and that seen in FIG. 1*b*. In the event that greater space is required to put all the elements of FIG. 1*a* on one side of the board, then the opposite side is accordingly lengthened. Accordingly, the ball position and yards-to-go position indicators seen at the bottom of FIG. 1*a* may be positioned across the fold line to adjust the entire board to the desired spacing.

On the board segment of FIG. 1*a*, there is basically provided a schematic representation of a football field preferably substantially scaled to proportional dimensions of an actual field. This field has end zones 15 and 16, as well as goal lines 17 and 18. The 10 yard markers are preferably full field width lines (as is conventional, same indicated at 19). The yardage designators or numbers on the 10 yard lines 19 are preferably provided paired and spaced apart as seen at 20. The five yard markers 21 (5, 15, 25, 35, and 45 yards from each end of the field) are of greater dimension than the single yardage indicators 22 which are provided without numbers running the entire length of the field on each side. Thus, with respect to the yardage indicators, the ten yard lines have yardage numbers paired thereon but spaced apart centrally, while the five yard dividers are numbered at each side of the field. The single yard markers are not numbered. Numbers for the five yard intervals are designated 21*a*.

The side lines 23 and 24 have elongate slotted guides 25 and 26 positioned just alongside thereof, guides 25 and 26 having slots 25*a* and 26*a* positioned substantially centrally thereof and opposed to one another across the field representation. Guides 25 and 26 preferably run the entire length of the field, on each sideline thereof, including the entire depth of the end zones 15 and 16 to the end zone out-of-bounds lines 27 and 28.

Figure 4:
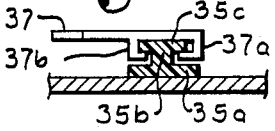
FIG. 4 is a view taken along the lines 4—4 of FIG. 1*a* in the direction of the arrows.

In the upper portion of FIG. 1*a* there are provided score marker zones 29 and 30, the former marked "Home" the latter marked "Visitors". In order that suitable score marking cards may be removably attached in zones 29 and 30, stub shafts 29*a* and 30*a* may be provided on which number bearing score cards 31 and 32 may be removably mounted as the game progresses. Zone 33 may be be provided for a down indicator, here typically shown as a pivoted arm 33*a* which may be moved between four numeral positions to give the down on which a team is working. Likewise, zone 34, in the sidelines area above the field in the view of FIG. 1*a* is shown provided with a pivotable marker arm 34*a* used to indicate which quarter of play is under way in progress in the game. Finally, parallel to the longitudinal axis of the field (and parallel to sidelines 23 and 24) and extending from end zone 16 to end zone 15, past each goal line 18 and 17, respectively, there is provided an elongate track 35 typically I-shape in section (FIG. 4) with base 35*a* and vertical intermediate portion 35*b* which slidably carries two position indicators 36 and 37 thereon. Indicators 36 and 37 typically have C section engaging arms as may be seen in FIG. 4 wherein are shown such arms 37*a* and 37*b* slidably engaging the track member 35 for movement therealong.

Figure 2:
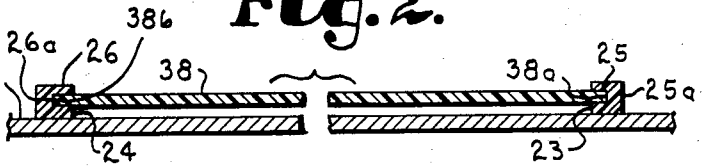
FIG. 2 is a view taken along the lines 2—2 of FIG. 1*a* in the direction of the arrows.
Figure 3:
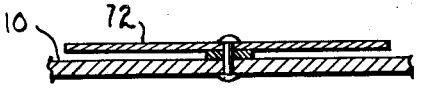
FIG. 3 is a view taken along the lines 3—3 of FIG. 1*b* in the direction of the arrows.
Figure 6:
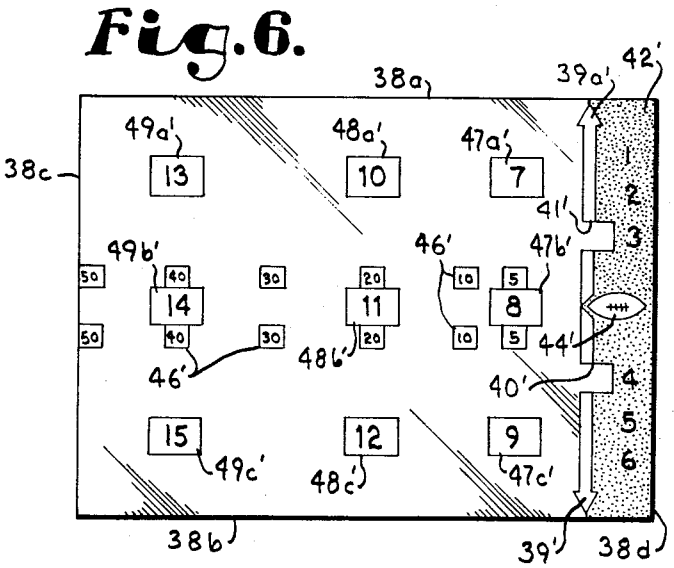
FIG. 6 is a plan view of a first side of the strategy selector slide, per se.
Figure 7:
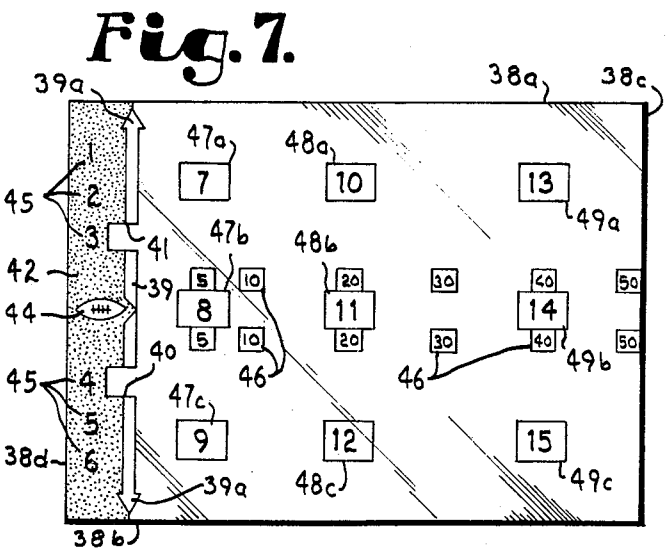
FIG. 7 is a plan view of the reverse side of the slide.

There is additionally provided a rectangular, partly transparent sheet of plastic or other equivalent material operating as a slide (generally designated 38) adapted to fit in and move along the slots 25*a* and 26*a* of guides 25 and 26 (FIG. 2). Slide 38 may be an essentially rigid piece of plastic material, whereby to be insertable in and removable from the slots 25*a* and 26*a* in the guides 25 and 26 only at the ends thereof, or, alternatively, it may be somewhat resilient whereas to be snappable in and out of the said slots by raising the center of the slide in arcuate upwardly arching fashion and vice versa. The width of the slide 38 (from side edge 38*a* to like parallel side edge 38*b*) is slightly greater than the sideline to sideline (23 to 24) width of the field so that same fits slidingly in the said slots 25*a* and 26*a* as seen clearly in FIG. 2. The thickness of the slide 38, at least in the side edge portions 38*a* and 38*b* thereof is only slightly less than the height of slots 25*a* and 26*a* so as to have a frictional but sliding fit therein. Preferably, but not necessarily, the thickness of the entire slide 38 is uniform.

The length of slide 38 is preferably in excess of 50 equivalent yards measured on the schematic field on board 10. Specifically, the transparent end (ending at end edge 38*c*) is preferably precisely 50 equivalent yards in length. On the other hand, the opaque portion of the slide, namely, the opposite end edge 38*d* and the portion closely adjacent thereto, is preferably less than 10 equivalent yards in width compared to field yardage. A transverse line 39 preferably having cut-out zones 40 and 41 therein (and also in the adjacent opaque transverse band 42 next the end edge 38*d* of slide 38) is provided which delimits the beginning of the entire 50 yard transparent zone (generally designated 43) and the much lesser size opaque zone 42. Transverse line 39 across slide 38 serves to designate the line of scrimmage in football game play and preferably has arrow indicators 39*a* at the ends thereof for precise registry with the yardage markers across and at the sides of the field.

The slide is identically marked on both sides thereof, but with all markings reversed from one side to the other thereon. In this manner, when the slide 38 is oriented as seen in FIG. 1*a*, it is oriented for football play moving from the goal line 18 and end zone 16 (the team defending same) toward goal line 17 and end zone 15. On the other hand, when the slide is removed from the guides 25 and 26 and turned over and reversed (so that the opaque zone 42 (see righthand side of field in dotted line representation) is to the right in the view of FIG. 1*a*) the slide is oriented for play in the opposite direction. That is, the team defending the goal line 17 before end zone 15 will be played toward and (hopefully for that team) moving toward the opposite goal line. The provision of this double-sided slide [the one end portion thereof transparent (at least substantially 50 yards equivalent length), together with the associated opaque zone portion of the slide on the other side of the indicated scrimmage line 39, special zone indicia being marked both on the opaque and transparent zones of both sides, reversed from side to side]is essential for the operation and playing of the instant game.

Turning to the indicia on the side of the scrimmage line 39 opposite the transparent portion of the slide (to the left of scrimmage line 39 in the view of FIG. 1*a*), the center of the scrimmage line is indicated by a suitable symbol, here a football representation 44. A set of uniformly spaced numerals 1 through 6 is positioned along the scrimmage line 39 on the opaque portion of the slide 38, the first three numbers on one side of the ball as seen and the second three numbers on the other side thereof. Each number is positioned to indicate a certain zone of the scrimmage line. Said numbers 1 to 6 marking a scrimmage line zone are designated 45.

Turning to the indicia indicated on each side of the transparent portion of slide 38 (reversed from side to side) yardage numerals for 5, 10, 20, 30, 40 and 50 yards are provided on each side of the longitudinal center of the slide at 46. These numerals are spaced inside of the field members 20 whereby to be visible with respect thereto simultaneously, with the said numerals 20 also visible through the transparency of slide 38. These distances are equivalent distances from the scrimmage line 39 and are marked on the slide only, as noted. Equivalent marked yardages on the slide and field are equal in actual length.

Zones 7, 8 and 9, as numbered at 47*a*, 47*b*, and 47*c* are numbered on slide 38, substantially equally spaced from one another and the sidelines at the five yard from scrimmage line 39 area. On the slide 38, in the transparent zone 43, at the 20 yard distance from scrimmage line 39 there are provided markers 10, 11 and 12 here designated 48*a*, 48*b* and 48*c* across the field, whereby to effectively mark for reference the three adjacent field zones at that distance from the scrimmage line.

It should be noted that the markers 7, 8 and 9 (47*a*, *b* and *c*) and 10, 11 and 12 (48*a*, *b*, and *c*) are spaced both with respect to the yardage markers 46 on the slide itself and the yardage markers 20 on the field whereby, at all times, all of these indicia are visible with respect to one another as the slide (the transparent portion thereof at any rate) is moved up and down the field. Finally, there are provided markers for zones 13, 14 and 15, the equivalent 40 yard distance from scrimmage line 39 with markers 49*a*, *b* and *c*, respectively.

Figure 5:
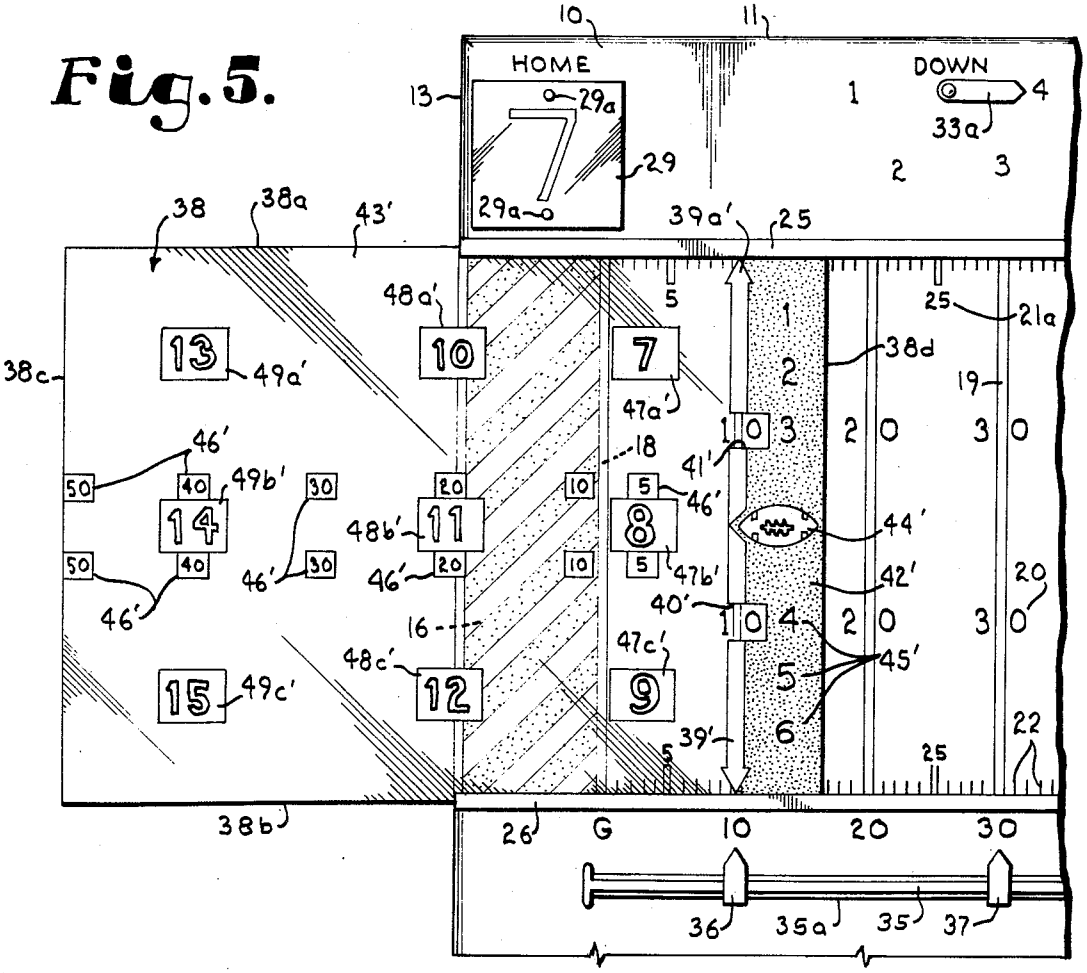
FIG. 5 is a view like that of FIG. 1*a* showing a fragmentary plan view of one part of the board of the subject game, the slide in this view reversed from the showing of FIG. 1*a* and positioned with the scrimmage line on the 10 yard line of one goal.

In FIG. 5, the major portion of the field is shown with the slide reversed and positioned for play closely adjacent to goal 18 (typical field goal or scoring position). The indicia on the opposite side of the slide from that side seen in FIG. 1*a* are numbered the same, but primed.

Turning to the array of probability dials or chance devices which are mounted on the outer portion of the board shown in FIG. 1*b*, the specific chance devices which are shown involve a fixed arrow or marker attached to the board with rotatable circular wheels or dials centrally attached and rotatably mounted on the board. Singly the individual dials may be spun by the players of the game with the rotatable discs coming to rest with a certain zone thereof next to the fixed indicator. Although not shown, the opposite alternative is feasible where the circular dial faces would be fixed to the board with a rotatable pointer centrally mounted thereon to be spun. Equivalent chance indicators or devices may be used in place of these two described forms.

The provision of such chance devices or written or tabular equivalents thereof enables all of the conventional operations and plays of the game football to be carried out on the board array immediately previously described. That is, kick-offs, run-backs, rushing, passing, punting and field goals all may be played on the game board with the array of chance devices shown.

Referring, then, to FIG. 1*b*, at 50 is generally designated the kick-off and punting dial having arrow or indicator 51. Next thereto in the same row is the run-back dial generally designated 52 with indicator 53. Rushing dial 54 has indicator 55 associated therewith. Next thereto is rushing bad dial 56 (for rushing and run-backs) with indicator 57. The next dial in the same row is the passing bad dial 58 with associated indicator 59. The final dial in that row is the kicking bad dial 60 with associated arrow or indicator 61 (for field goals, punts and extra points).

The second or lower row of chance devices or probability dials in FIG. 1*b* is a series of dials each directed to field goals and passes. On the left is the five yard passing and field goal dial 62 with indicator 63, which also serves with respect to extra points after touch-down. Next thereto is ten yard passing and field goal dial 64 with indicator 65. The twenty yard passing and field goal dial 66 has indicator 67 associated therewith. Thirty yard passing and field goal dial 68 has cooperating indicator 69. Next thereto is the forty yard passing and field goal dial 70 with its indicator 71. Finally, at the righthand side of the row there is provided the fifty yard passing and field goal dial 72 with its indicator 73.

Returning to the slide 38, this slide serves as a strategy selector which slides up and down the field in the course of play, reversing direction as the ball changes hands. The line 39 always marks the line of scrimmage. The numbers 1–6, inclusive, on the opaque end thereof designate rushing slots in play. The numbers 7–15, inclusive, on the transparent end of the selector designate passing zones or areas.

Thus, referring to the use of the strategy selector in play utilizing the elements of this board game, if a quarterback wants to rush, he must rush through a selected slot. If a quarterback wants to pass, he must pass to one of the areas 7–15, inclusive. Specifically, with respect to the latter, if the quarterback wants to throw a five or ten yard pass, he must select areas 7, 8 or 9. If he wants to throw a twenty or thirty yard pass, he must select one of areas 10, 11 or 12. Finally, if he wants to throw a forty or fifty yard pass, he must select one of areas 13, 14 or 15.

Referring to kick-off and punt dials 50 and 60, respectively, the latter representing "bad" kicks, the detailed structure of the dials is as follows. Zone 50*a* represents an on-side kick. Zones 50*b* through 50*h* give yardages from 30 to 70 at five yard intervals on the larger area zones and 10 yards in those of smaller area. The higher yardage zones are of lesser area. Zone 50*a* also represents a 15 yard kick in a punt situation.

Turning to dial 60, zone 60*a* is a penalty zone subdivided into 5 and 15 yard portions. Zone 60*b* represents yards lost on a bad kick and is sub-divided into 10 and 20 yard zones. Zone 60*c* represents a blocked kick. The areas of each of these zones are different to give different probabilities of selection on spin of the dial.

Dial 52 is the run-back dial and has three zones 52*a*, 52*b* and 52*c*. Zone 52*a* is sub-divided into 5, 10 and 15 yard selection zones with each of zones 52*b* and 52*c* being sub-divided for run-backs of 20 to 80 yards. The dial sub-zones are smaller sized, as the run-back yardage increases, because of their normal lesser probability. The same is true with respect to zones 52*a*, *b* and *c* again on the basic grounds of probability.

The effective (good) rushing dial is dial 54, while the bad or unsuccessful rushing dial is next thereto at 56. In the former, there are three zones 54*a*, 54*b* and 54*c* with the former being of greater area and the latter of lesser area. Zone 54*a* is successful, but conservative, rushing in the one to nine yard gain range with the individual yardages having separately sub-divided sub-zones of zone 54*a* representing same. The quite successful, but yet limited, rushing zone 54*b* has separate sub-zones for 10, 15, 20 and 25 yard gains. Finally, the least total area zone 54*c* has three sub-zone divisions of 30, 40 and 50 yard runs.

Unsuccessful or bad rushing dial 56 has three zones 56*a*, 56*b* and 56*c*. The 56*a* zone is a fumble zone where the ball may change hands. The 56*b* zone has sub-divisions of 10 and 20 yards lost. The 56*c* zone is a penalty zone with 5 and 15 yard sub-zones therein.

The six "good" or successful passing dials are dials 62, 64, 66, 68, 70 and 72. However, each of said dials includes an incomplete pass zone therein. Additionally, the said dials 62, 64, 66, 68, 70 and 72 also represent field goal success or lack of success and have a "no good" zone thereon. Since the probability of a successful field goal at a given distance is greater than that of a successful pass at the same distance, the "incomplete" passing zone is of larger area than the "no-good" field goal zone on these particular dials. Yet further, since, once a pass is received by a player, there is a possibility of an additional run, there is a small touchdown (T.D.) zone on each of these dials, as well. Turning, then, to the dials, at 62*a*, 64*a*, 66*a*, 68*a*, 70*a*, and 72*a*, there is seen the said touch-down or T.D. zone. The incomplete pass zones are designated by the arrows 62*b*, 64*b*, etc. through 72*b*. The failed field goals are defined by the "N.G." or no-good arrows 62*c*, 64*c*, etc. through 72*c*. Suitable lines are provided on the dials 62, 64, etc., through 72 whereby to define these particular zones. As is evident, the zone outside of the incomplete pass arrows 62*b*, 64*b*, etc., when a pass is being "dialed", represents a successful pass for the yardage of the indicator and dial involved. Similarly, the zone outside of the no-good field goal arrows 62*c*, 64*c*, etc., defines a successful field goal at the yardage indicated on the particular dial and indicator arrow.

Alternatively or in addition to the arrow markings and radial lines seen in the dials 62, 64, 66, 68, 70 and 72 colors may be employed to designate the various arcuate zones, e.g. red for poor results, yellow fair results, and blue excellent results (touchdown).

Numerous of the other alternatives with respect to a bad or unsuccessful pass are provided by dial 58 which has zones 58*a* (fumble), zone 58*b* (penalties of 5 or 15 yards), the interception with run-back zone 58*c* and, finally, zone 58*d* directed to yards lost with sub-zones of 10 and 20 yards therein. With respect to the pass interception with run-back, the run-back dial 52 is used with this, as well as with respect to the kick-off and punt dial 50.

Returning to the slide 38 previously described, and referring particularly to the indicia marked on both sides thereof, the following is the case. First, the six rushing zones designated by the numerals 1–6, inclusive, at 45 and 45' are divided into three groups. Thus, the numerals 1 and 2 are colored blue. This defines a first rushing zone at the scrimmage line and therepast. Numerals 3 and 4 are colored red so that there is a second, central rushing zone on the scrimmage line and therepast. Numerals 5 and 6 are colored yellow, thus to define a third rushing zone at the other end of the scrimmage line, on both sides thereof.

Additionally, referring to the passing zone numbers 7–15, inclusive, in addition to the numbers per se, they are themselves color-coded so as to provide and define three zones at varying distances from the line of scrimmage. Thus, numerals 7, 8 and 9 at 47*a*, *b* and *c* are colored red. The same is true of the corresponding primed numbers on the other side of the strategy selector slide 38. The numerals 10, 11 and 12 are colored yellow, thus to define the second zone. The numerals 13, 14 and 15 are colored blue to define the third zone, these numerals being at 49*a*, 49*b* and 49*c*, with numerals 10, 11 and 12 seen at 48*a*, 48*b* and 48*c*.

In operation of the game, it should be understood that the use of the game is particularly directed toward function as an educational device. The number of players may conveniently be two (one representing each side or team) up to 30. That is, roughly one to fifteen on each team. It is not necessary to have equal numbers of players on each team. The suggested ages for playing the game are ages 9 through adults. The general uses of the game may be conveniently categorized as follows:

1. Classroom teaching aid — Teaching social studies, science, mathematics, English, reading, geography, music, Bible study, etc. (at any grade level);

2. Home teaching aid — multiplication tables, other mathematics fundamentals, grammar fundamentals, requirements for scouting badges, etc.;

3. Adult entertainment — Questions directed to political, marital, occupational subject matter, etc.;

4. Family entertainment — Facts of common knowledge, facts of current events, humorous events, etc.;

5. Panel or quiz games — Varieties of questions organized around any pre-selected subject matter.

in order to adequately define and delineate the functions of the parts and elements of the game board array previously described, typical game use instructions will first be given and, thereafter, the playing rules which are particularly adapted to this game board and the operating and functional elements thereof.

TYPICAL GAME USE INSTRUCTIONS (COPYRIGHT, ROBERT E. CUMMINS 1975)

1. General Pro football rules are preferably used. College rules may be used.

2. The adminstrator of the game functions as the Referee.

3. The Referee selects questions before the game begins, and places individual question slips or tags into a container. (Average: one question per minute.)

4. If Referee deems it necessary, questions may be reviewed by players before game begins.

5. Referee chooses two team captains.

6. Captains choose teams and team names.

7. Teams may sit on side of "field" (room) that corresponds to goal they defend.

8. Each player, in turn, is considered Offensive Quarterback (or coach) and has two responsibilities: Choose preferred strategy, and answer one (or two) questions.

9. Each player, in turn, is considered Defensive Captain and has two responsibilities: choose and write down preferred Defense, and announce immediately to Referee that "Defense is in".

10. Situations when Quarterback can elect to answer only one question:

a. runbacks (interceptions, punts, or kickoffs)

b. punting c. extra point attempt d. 5 yard field goal or 5 yard pass.

11. Situations when Quarterback can elect to answer two questions:

a. rushing b. 10, 20, 30, 40 and 50 yard passes.

c. 10, 20, 30, 40, and 50 yard field goal.

12. In the event a question is answered incorrectly, it is immediately considered an incorrect response. (If first question is answered incorrectly, a second question will not be given.)

13. Any time a question is answered incorrectly, only bad things can happen — such as: penalty, fumble, loss of yards, pass intercepted, kick blocked, loss of ball.

14. Quarters: (for 60 minute game) Four 12 minute quarters are played. For best results, use a timer. When timer goes off to end 1st or 3rd quarter, the next quarter begins without interruption. (No need to change ends of field, there is no wind advantage, etc.)

15. End of Half and End of Game: The buzzer serves as a 2 minute warning. There will be 2 plays left from line of scrimmage. Team that did not receive the opening kickoff, will receive the kickoff to start the second half.

PLAYING RULES (COPYRIGHT, ROBERT E. CUMMINS, 1975)

The game begins with a kickoff from the 35 yard line. Spin Kickoff Dial 50, and move the ball marker (36 or 37 depending on direction of kickoff) the number of yards designated on the dial.

KICKOFFS

I. Player up receives kick-off and will answer a runback question.
  A. Runback (no defense):
    1. Receiver of kick-off must answer one question.
      a. Correct answer — Result: Spin Runback Dial 52.
      b. Incorrect answer — Result: Spin Rushing Bad Dial 56.

II. There are two situations whereby a runback does not follow a kick-off.
  A. Onside Kick: (Dial 50, 50*a*)
    1. Ball goes to midfield.
    2. Flip coin to see which team recovers (kicking team captain calls heads or tails).
  B. Player up chooses to down ball in end zone for a touchback.
    1. Ball goes to 20 yard line.
    2. 1st and 10 from that point.

III. Kick-off following a safety is initiated from the 20 yardline instead of the 35 yard line.

OFFENSE

I. Strategy Selector Slide 38 is placed on Game Board engaged by slots 25*a* and 26*a* of guides 25 and 26 so that the red arrow 39 marks the line of scrimmage.

II. Quarterback has four options: rush, pass, punt, or kick field goal.
  A. Rushing: Quarterback chooses a rushing slot number 45 (1 through 6) from the Strategy Selector slide 38.
    1. Factors that increase yards gained by rushing:
      a. One question taken, correct answer — Result: Spin Rushing Dial 54.
      b. Two questions taken, correct answer — Result: Spin Runback Dial 52.
      c. Poor Defense
      1. Defense chooses rushing, but wrong color — Result: Two yards gained for each number off, plus yards designated on Rushing Dial 54.
      2. Defense chooses passing (when rushing play was selected by Offense)
        a. If Defense chose slide 38 zones 13, 14 or 15 (a 40 or 50 yd. pass). Result: 15 yard gain, plus yards on Rushing Dial 54.
        b. If Defense chose slide 38 zones 10, 11, or 12 (a 20 or 30 yd. pass). Result: 10 yard gain, plus yards on Rushing Dial 54.
        c. If Defense chose slide 38 zones 8, 8, or 9 (a 5 or 10 yd. pass). Result: 5 yard gain, plus yards on Rushing Dial 54.
    2. Factors that decrease yards in rushing:
      a. Defense stops Offense at line of scrimmage (by selecting correct rushing color).
      1. If Quarterback answers question correctly — Result: Automatic no gain.
      2. If Quarterback answer question incorrectly Result: Automatic fumble and loss of ball at line of scrimmage.
      b. Defense sacks Quarterback for 10 yd. loss (by selecting exact rushing number).
      1. If Quarterback answers question correctly — Result: Automatic 10 yard loss.
      2. If Quarterback answers question incorrectly — Result: Automatic 10 yd. loss, fumble, and loss of ball.
      c. Although defense did not choose correct rushing color or exact passing number, if Quarterback answers question incorrectly — Result: Must spin Rushing Bad Dial 56.
  B. Passing: Quarterback chooses a passing area number (7–15) from the Strategy Selector slide 38. [Note: End zone measures 10 yards. A pass may not be completed beyond the end lines 27 or 28.]
    1. Combined factors that increase probability of completion:
      a. If Quarterback chooses additional question, answers correctly — Result: Move (right to left) one Passing Dial from dial representing length of chosen pass.
      b. And poor Defense — Result: Continue to move (right to left) one Passing Dial for each lane and depth Defense was off.
      1. Poor Pass Defense occurs when Defense:
        a. chooses passing, but wrong area.
        b. chooses a rushing zone number.
    2. Factors that decrease probability of completion.
      a. Defense chooses exact passing zone number.
      1. If Quarterback answers question correctly — Result: automatic incomplete.
      2. If Quarterback answer question incorrectly — Result: Automatic interception with runback (note: player in turn on opposite team accepts the runback question).
      b. Defense does not choose exact passing number.
      1. And Quarterback answers question incorrectly — Result: Spin Passing Bad Dial 58.
  C. Punting: Quarterback elects to punt. (Note: Punter can take only one question)
    1. After Defense is in, Quarterback announces that he is punting. This cancels previous Defense.
    2. Should dial stop on onside — punt is 15 yards.
    3. Defense then has an opportunity to blitz (by selecting one of the three colors from the rushing slots 45 on the Strategy Selector dial 38).
      a. After deciding whether or not to blitz, the Defense restates "Defense is in."
      b. The punter can protect two colors against a blitz. He must announce the color left unprotected.
      c. A successful blitz occurs when the Defense attacks a protected color.
      d. An unsuccessful blitz occurs when the Defense attacks a protected color. [NOTE: Anytime there is no blitz — Simply spin dial 50 (correct answer) or dial 60 (incorrect answer).]
    4. Factors that increase length of a punt:
      a. Correct answer, unsuccessful blitz — Result: Spin Punting Dial 50, plus 20 yards and no runback.
    5. Factors that decrease length of a punt:
      a. Incorrect answer, no blitz or unsuccessful blitz — Result: Spin Kicking Bad Dial 60.
      b. Correct answer, successful blitz — Result: Partially blocked, spin Punting Dial 50, punt will be ½ of number on dial (runback as usual).
      c. Incorrect answer, successful blitz — Result: Kick blocked, with runback from line of scrimmage.
  D. Field Goals: Quarterback elects to kick a field goal.
    1. After Defense is in, Quarterback announces that he is going to attempt a field goal. This cancels previous Defense.

2. Defense then has an opportunity to blitz (by selecting one of the three colors from the rushing slots 45 or 45' on the Strategy Selector).
   a. After deciding whether or not to blitz, the Defense restates that "Defense is in".
   b. The place kicker can protect two colors against the blitz. He must announce the color left unprotected.
   c. A successful blitz occurs when the Defense attacks the color unprotected.
   d. An unsuccessful blitz occurs when the Defense attacks a protected color.
3. Factors that increase field goal probability:
   a. Correct answer (one question), no blitz — Result: Spin appropriate dial 62, 64, etc..
   b. Additional question, correct answer — move up one dial (right to left).
   c. Correct answer, unsuccessful blitz — Result: 5 or 10 yd. field goal automatically good. For 20, 30, 40 or 50 yd. field goal, move up (right to left) an additional 2 dials.
4. Factors that decrease field goal probability:
   a. Incorrect answer, unsuccessful or no blitz — Result: Spin Kicking Bad Dial 60.
   b. Correct answer, successful blitz — Result: 40 or 50 yd. kick automatically no good. 5, 10, 20, or 30 yd. kick, move back (left to right) two dials.
   c. Incorrect answer, successful blitz — Result: Kick automatically blocked with runback from line of scrimmage (no runback on extra point attempt).
5. All missed field goals result in touchbacks.

DEFENSE

I. Defensive Captain has 10 seconds to write down a Defense play number. When he has selected a number, he announces "Defense is in". (Then Offensive Quarterback announces his chosen play.)

II. Options available to Defensive Captain:
   A. Stop rushing play (by choosing a rushing number, 1 through 6, at 45 on the Strategy Selector slide 38.
      1. Same color, correct answer — Result: No gain.
      2. Same color, incorrect answer — Result: Fumble and loss of ball at the line of scrimmage.
      3. Same number, correct answer — Result: 10 yd. loss.
      4. Same number incorrect answer — Result: 10 yd. loss, plus fumble and loss of ball.
   B. Stop passing play (by choosing a passing area number, 7 through 15, on the Strategy Selector slide 38.
      1. Close proximity to chosen Offense decreases chances of completion.
      2. Same number exactly, correct answer — Result: Automatic incomplete.
      3. Same number, incorrect answer — Result: Automatic interception with runback.
   C. Stop punt (blitz and attempt to block punt)
      1. Choose blitzing color (yellow, red or blue from rushing slots 45 on Strategy Selector slide 38).
      2. Kicking team must leave one color unprotected.
         a. Kicking team announces that it is punting and which of the three colors it is leaving unprotected.
      3. Successful blitz occurs when Defense attacks unprotected color.
      4. An unsuccessful blitz occurs when Defense attacks a protected color.
   D. Stop field goal (blitz and attempt to block field goal).
      1. Choose blitzing color (yellow, red, or blue from rushing slots 45 on Strategy Selector slide 38).
      2. Kicking team leaves one color unprotected.
         a. Kicking team announces that it is kicking a field goal, and which of the three colors it is leaving unprotected.
      3. A successful blitz occurs when the Defense attacks an unprotected color.
      4. An unsuccessful blitz occurs when the Defense attacks a protected color.

III. Procedure for marking Defensive cards:
   A. To stop Rushing play, print choice of rushing zone number 45, 1 through 6.
   B. To stop passing play, print choice of passing zone number, 7 through 15 (47–49, inclusive).
   C. To stop Punt play if blitzing, print blue, red or yellow — if not, print "no blitz" (or symbols for same).
   D. To stop Field Goal play, same procedure as in Stop Punt play (supra III C).

RUNBACKS

I. A runback question will be given in the following cases:
   A. After all kickoffs.
   B. After all punts.
   C. After all intercepted passes. [NOTE: All runbacks from inside endzone will begin at goal line.]

II. Only one question will be given for all runbacks.
   A. If runback question is answered correctly — Result: Spin Runback Dial 52.
   B. If runback question is answered incorrectly — Result: Spin Rushing Bad Dial 56.

PENALTIES

I. All penalties are automatic. No options to accept or decline will be given.

II. Penalties result in loss of designated yards without loss of down. Exceptions: Unsportsmanlike conduct and Offensive delay of game result in loss of down.

III. A penalty cannot result in a safety.
   A. Penalty will be half of distance to the goal line.

IV. Types of Penalties:
   A. Bad Dial Penalties (Rushing 56, Passing 58, or Kicking 60) Result: 5 or 15 yd. loss — down repeated.
   B. Delay of game:
      1. Defensive delay of game: Defense takes longer than 10 seconds to select strategy. Result: 5 yd. gain — down repeated.
      2. Offensive delay of game: Offense takes longer than 10 seconds to select strategy (after Defense is in). Result: 5 yd. loss — loss of down.
   C. Unsportsmanlike conduct: Called by Referee whenever deemed necessary. Result: 15 yd. loss — loss of down (penalty on Offense). 15 yd. gain — automatic 1st down (penalty on Defense).

FUMBLES

I. All Bad Dial Fumbles (Rushing 56, Passing 58, or Kicking 60) will be decided by a flip of a coin. This gives Quarterback an opportunity to recover his own fumble.

II. All fumbles caused by a good rushing Defense (same number, or same color) and incorrect answer will result in the Defense automatically recovering the football.

YARDS LOST

I. Yards can be lost by:
A. Result of Bad Dials (Rushing 56, Passing 58, or Kicking 60).
B. Correct rushing zone number 45 selected by Defense.
II. Yards lost can result in a safety.

PASS INTERCEPTED

I. A pass can be intercepted by:
A. Result of Passing Bad Dial 58.
B. Correct passing zone number 47–49, inclusive selected by Defense (with incorrect answer).
II. All intercepted passes are followed by a runback. (Runback question must be answered.)

KICK BLOCKED

I. A punt or a field goal can be blocked by:
A. Result of Kicking Bad Dial 60.
B. Result of successful blitz and incorrect answer.
II. All blocked kicks will result in a runback from the line of scrimmage.
A. Runback question will be given.

EXTRA POINT (Point After Touchdown)

I. The point after touchdown will be kicked from the five yard line.
II. The rules for the extra point conversion are identical to those for a 5 yd. field goal.
A. An unsuccessful blitz makes the extra point automatically good (with correct answer).
B. A successful blitz moves the probability back two dials (with correct answer)
III. Anytime an incorrect answer is given, extra point is automatically no good.

DOWNS

I. The Offensive team has 4 downs to gain 10 yards. If they gain at least 10 yards, they then have 4 more downs to gain 10 more yards (general football rules).
II. The Red Arrow Indicator 33*a* on the game board indicates the number of down. (The White Arrow Indicator 34*a* indicates the quarter.)
III. The Yards-to-Go Marker is indicator 36 (or 37) that slides up and down the field. (The line of scrimmage is marked by the Strategy Selector slide 38 by its arrow 39.)

DOWN BALL (IN END ZONE)

If a player does not wish to risk a runback from the end zone he may down the ball, thus creating a touchback (1st and 10 from 20).

TOUCHBACKS

I. Touchbacks occur when:
A. Intercepted pass is downed in endzone
B. Kickoff downed in endzone
C. Punt downed in endzone
D. Distance of punt or kickoff puts the ball beyond end line (27 or 28).

FAIR CATCH

A fair catch can be made following and punt or kickoff.
Result: 1st and 10 from that point.

From the foregoing, it will be seen that this invention is one well adapted to attain all of the ends and objects hereinabove set forth together with other advantages which are obvious and which are inherent to the apparatus.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

I claim:

1. A game device comprising, in combination,
a game board having thereon a substantially scaled representation of a football field including two end zones and the 100 yard field therebetween, with at least the customary 10 yard transverse line indicators thereon,
a rectangular slide of width substantially equal to the width of the field and a length at least somewhat greater than 50 yards equivalent on the board field representation,
means on the board for removably receiving the slide in engagement therewith operative to permit longitudinal sliding motion of the slide back and forth along the longitudinal axis of the field, with the side edges of the slide substantially in alignment with the sidelines of the field and the end edges of the slide normal to the longitudinal axis of the field,
the slide transparent on one end in substantially 50 yards length equivalent on the board and the full width thereof, whereby the football field center and sideline markings are visible therethrough,
said slide having a transverse line of scrimmage marking thereon on both sides thereof adjacent the end opposite the transparent end thereof, whereby the slide may be turned over and reversed from a first position on the board representing play in one direction on the field to a second position on the board representing play in the other direction on the field.

2. A game device as in claim 1 wherein the slide has like spaced markings on each side thereof, in the transparent portion thereof, designating selected areas of the field with respect to the scrimmage line markings on that side.

3. A game device as in claim 1 wherein the area of each side of the slide on the side of the scrimmage line indicated thereon away from the transparent slide part is marked along the scrimmage line to designate selected areas of the field next to the scrimmage line.

4. A game device as in claim 1 wherein the slide has like spaced markings on each side thereof, in the transparent portion thereof, designating selected areas of the field with respect to the scrimmage line marking on that side and
the area of each side of the slide on the side of the scrimmage line indicated thereon away from the transparent slide part is marked along the said scrimmage line to designate selected areas of the field next to the scrimmage line.

5. A device as in claim 1 including a pair of score marking zones, down and quarter indicators and ball and yardage position indicators positioned adjacent to and along side line boundaries of the field and the board.

6. A device as in claim 1 including a plurality of chance devices associated with said board, said chance devices each including a circular dial face with arcuate divisions of the area thereon into zones, and a pointer, the dial face and pointer relatively rotatable, one with respect to the other.

7. A device as in claim 6 wherein said chance devices are positioned in parallel arrays in a separate zone of the board adjacent to one of the sidelines, each said array oriented substantially parallel to the longitudinal axis of the field.

* * * * *